United States Patent [19]

Baer et al.

[11] Patent Number: 5,016,708

[45] Date of Patent: May 21, 1991

[54] APPARATUS AND METHOD FOR PRODUCING AND CLEANING AN OIL WELL

[76] Inventors: Robert L. Baer, 949 Scott St., Palo Alto, Calif. 94301; Ben H. Kimball, 25125 Linwood, Visalia, Calif. 93277

[21] Appl. No.: 433,659

[22] Filed: Nov. 8, 1989

[51] Int. Cl.[5] ..... E21B 33/03; E21B 37/00; F16G 1/21

[52] U.S. Cl. ..... 166/75.1; 166/77; 198/643; 474/264

[58] Field of Search ..... 166/75.1, 77, 311, 303, 166/369, 72; 198/643, 731, 733; 210/359, 400, 401, 526; 474/264, 255, 268

[56] References Cited

U.S. PATENT DOCUMENTS

| | | | |
|---|---|---|---|
| 3,314,545 | 4/1967 | Grabbe et al. | 210/526 |
| 3,765,489 | 10/1973 | Maly | 166/77 X |
| 3,774,685 | 11/1973 | Rhodes | 198/643 X |
| 4,089,784 | 5/1978 | Ettelt et al. | 210/526 |
| 4,137,170 | 1/1979 | Tateishi | 210/526 X |
| 4,552,220 | 11/1985 | Jones | 166/369 |
| 4,634,411 | 1/1987 | Oliver | 474/264 X |
| 4,834,880 | 5/1989 | Lundin | 198/643 X |

*Primary Examiner*—Thuy M. Bui
*Attorney, Agent, or Firm*—Harold D. Messner

[57] ABSTRACT

An apparatus and method provide for the efficient pumping of fluids from an earth formation penetrated by a wellbore, and simultaneously provide for clean out of channels associated with the producing zone of the formation.

In one aspect, an endless belt of two plies of material is driven into and from a pool of oil and water via a collection station at the earth's surface. Also within the collection station is a squeezing subassembly. Broad surface contact between the squeezing subassembly and belt coupled with an almost complete absence of scraping action, reduce wear of the belt.

In another aspect, a series of drive drums are also positioned within the collection station, two of which sandwich the squeezing subassembly. They provide driving pressure to the belt.

In yet another aspect, pluralities of fastener assemblies are used to tie the two plies of belt material together along coincident broad surfaces. Each of these fastener assemblies includes a reduced section that pentrates through the belt into permanent contact with a cap-like wedge that form, with like wedges, a sprocketed tread.

Still further, a layer of the belt can be constructed from a high strength plastics material along which the sprocketed tread lays, in association with the second layer formed of a hydrophilic (water absorbing) material such as felt. Such composite belt construction, hence, permits both removal of water and oil from the formation at the same time.

31 Claims, 8 Drawing Sheets

94a
94b
89a
85
94c
94d
93a
90a
92a
93b
72
87
89b
91a
93e
93c
92b
D
93f
90b
91b
93d
92c
90c
92d
93g
89c
93h
94f
94e
90d
88
86
89d
88
94g
94h

APPARATUS AND METHOD FOR PRODUCING AND CLEANING AN OIL WELL

FIELD OF THE INVENTION

In general, the present invention relates to efficient pumping of fluids from an earth formation penetrated by a wellbore. In more particular detail, the invention simultaneously provides for the clean out of channels associated with the producing zone of the formation.

To achieve the above-listed goals, a two-ply, endless belt, rectangular in cross section, is driven via a collection station at the earth's surface into contact with a pool of formation fluids deep within the earth. Also within the collection station is a squeezing subassembly, independently operational. The latter comprises a pair of rotatable sheaves in separate circumferential contact with the moving belt after the latter exits from the wellbore. Broad surface contact between the sheaves and belt coupled with an almost complete absence of scraping action, reduces wear of the belt. But transfer of the oil from the belt to a holding tank within the collection station, easily occurs.

A series of drive drums are also positioned within the collection station, two of which sandwich the squeezing subassembly. They provide driving pressure to the belt. One of the drive drums is also designed to reverse the rectilinear direction of horizontal travel of the belt as well as help to drive the latter down into the wellbore. In side elevation, the combination of the large diametered drive drums, squeezing subassembly and moving belt, resembles a truncated figure-eight.

Since both of the drive drums are of a common large diameter but are not in actual physical contact with the squeezing sheaves, the functions of each of the subassemblies can be efficiently maximized. A separately spaced set of alignment drums vertically adjacent the well bore, complete the uphole assembly.

Pluralities of fastener assemblies are positioned along the endless belt. They are used to tie the two plies of belt material together along coincident broad surfaces. For this purpose, each of these assemblies includes a reduced section that penetrates through the belt into permanent contact with a cap-like wedge. Because of the shape and geometrical pattern, the series of wedges also forms a sprocketed tread that movingly adheres to the surfaces of the drive drums during operations.

Still further, one ply of the belt can be constructed from a high strength plastics material. Such material permits oil to adhere to various surfaces without penetration but also is strong enough to be able to withstand contact with the drive drums without fracturing. The other ply should be formed a hydrophilic (i.e. water-absorbing) material. Use of such composite construction allows both removal of water and oil from the formation at the same time. As a result, fluid level within the production zone can be more effectively lowered. And the formation channels for oil transfer can more easily become unplugged (mainly because of the reduction in associated backpressure).

BACKGROUND OF THE INVENTION

Discovering oil or natural gas, is directly related to its depth within the producing earth formation. That is to say, the shallower the reservoir below the earth's surface, the greater likelihood of its discovery and subsequent development.

Since shallow oil fields were thus first discovered and developed, they are now among the oldest of all presently producing fields. But they also represent a surprisingly large proportion of oil production in may regions, especially in the United States.

These fields are further characterized by relatively low production rates. In California, Texas and Oklahoma, for example, present average production rates are well below 100 barrels per day per well.

At the same time, many of these wells suffer from plugging problems associated with their age or environment, i.e., channels within the formation and/or perforations within the casing, become filled with particulate matter such as sand. There many be an additional requirement for mechanical pumps to lift the oil to the surface. Hence, many of these fields have reached a point in their economic lives, where the rates of producing wells are marginal when compared to the present worth of a barrel of oil.

Where the estimated oil-in-place has been fully depleted, nothing can be done. But where there is still a minimum volume of oil-in-place, a study of the present worth of oil might indicate that the field wells could be economically worked. For example, sufficient oil may justify: the use of methods to remove sanding problems; institution of low pumping rates; capping the wells and await future development; or selling the lease.

Heretofore, pumping assistance has been most prominently achieved by lowering a pump into the wellbore to a position below the surface of the pool of oil and water. The pump is then activated by a series of reciprocating rods positioned in the wellbore. At the earth's surface, a walking beam and counterweight at the earth's surface is usually used to initiate rod movement. Since the beam and weight resembles a horse's head, this pump type is called a "horse head pump".

In order to install the horse head pump, a large tower is required to be placed over the wellbore. After pumping has been started, the tower is removed, all at considerable expense. Additional problems associated with such pumping systems, aside from initial high costs, are as follows: (i) High maintenance costs due in part to failures due to "pump pounding" vibration, i.e., fluid level falls below a minimum at the downhole pump, (ii) Large energy needs to drive the downhole pump, (iii) High operating expense especially in those situations where downhole packers are used to avoid sanding problems, (iv) Noise, and (v) Low pumping efficiency in certain situations as where the oil is highly viscous.

In these circumstances, the prior art has recognized the need for a more economical means for lifting the oil and water. For example, in U.S. Pat. No. 4,552,220 for "OIL WELL EVACUATION SYSTEM", an endless belt is described to be driven from the earth's surface towards an anchoring unit at the bottom of the wellbore. The belt includes a series of connected linkages to which a plurality of open containers are appended. The containers dig into the accumulated matter near the bottom of the wellbore and then pass upwardly though the water and oil and thence to the earth's surface. After being inverted, the containers return to the wellbore and repeat the operation. But since the containers extend radially from the belt near the side wall of the wellbore, care must be exercised to choose situations where the wellbore is both straight and large enough to handle both the containers and belt. Also since the containers pass through the water first on the return trip up the wellbore, lifting is sequential: water is produced first followed by oil. Moreover, such design specifies that enlarged plastic shoulders on the containers be used to minimize the contact area. In addition, centering rollers are also recommended. Consequently, such a system is difficult to construct, expensive to operate and costly to maintain.

In U.S. Pat. No. 3,774,684 for "OIL MOP METHOD AND APPARATUS FOR PRODUCING AN OIL WELL", a rope-like belt is made from wound plastic fibers such as polypropylene for the purpose of selectively lifting oil, not water. Since the belt is also of circular cross section, the oil is scrapped off by squeezing the belt between a series of rollers. But only sectors of the belt are scrapped; the sides are unaffected. Hence use of such system can be inefficient in those applications where both oil and water are to be lifted simultaneously.

In U.S. Pat. No. 4.089,784 for "BELT TYPE OIL REMOVAL UNIT", a belt skimmer is described comprising an endless belt loop that can be submerged in the oil. The belt is driven by a rotary drum that has an irregular surface and a spring-biasing means to urge the belt against the drum in a positive manner. The oil adheres to the belt, is carried up to the earth's surface and then is cleaned by a scraper. But since the belt is formed of plastic materials that are hydrophobic, such system cannot be used effectively in those applications where both oil and water are to be lifted simultaneously or where it is desired to reduce the fluid level within the wellbore as rapidly as possible. Also a scraper is undesirable in many circumstances as where wear of the belt is a problem.

SUMMARY OF THE INVENTION

In accordance with the present invention, an apparatus and method are described which in general provide for the efficient pumping of fluids from an earth formation penetrated by a wellbore. In particular, the invention simultaneously provides for clean out of channels associated with the producing zone of the formation.

To achieve these goals, the invention provides for the use of a two-ply, endless belt, rectangular in cross section, to be driven into and from a pool of oil and water via a collection station at the earth's surface. Also within the collection station is a squeezing subassembly, independently operational. The latter comprises a pair of rotatable sheaves in separate circumferential contact with the moving belt. Broad surface contact between the sheaves and belt coupled with an almost complete absence of scraping action, reduce wear of the belt. But transfer of the oil from the belt to a holding tank within the collection station, easily occurs.

A series of drive drums are also positioned within the collection station, two of which sandwich the squeezing subassembly. They provide driving pressure to the belt. One of these drive drums also reverses the rectilinear direction of horizontal travel of the belt to drive the latter back down into the wellbore. In side elevation, the combination of the large diametered drive drums, squeezing subassembly and moving belt, resembles a truncated figure-eight.

Since these drive drums are of large diameter but are not in actual physical contact with the squeezing sheaves, the functions of each of these subassemblies can be efficiently maximized. A separately spaced set of alignment drums vertically adjacent the well bore, complete the uphole assembly.

Pluralities of fastener assemblies are used to tie the two plies of belt material together along coincident broad surfaces. Each of these assemblies includes a reduced section that penetrates through the belt into permanent contact with a cap-like wedge. Because of the shape and geometrical pattern, the series of wedges also forms a sprocketed tread that movingly adheres to the surfaces of the drive drums during operations.

Still further, one ply of the belt can be constructed from a high strength plastics material chosen from the group of materials that include oriented fibers of polyester, polyethylene, polybenzimibazole, para-aramid, graphite, boron and silicon carbide. These materials permit oil to adhere to various surfaces without penetration but also is strong enough to be able to withstand contact with the drive drums without fracturing. The other ply should be formed a hydrophilic (i.e. water-absorbing) material. Use of such composite construction allows both removal of water and oil from the formation at the same time. As a result, fluid level within the production zone can be more effectively lowered. And the formation channels for oil transfer can more easily become unplugged (mainly because of the reduction in associated backpressure).

Downhole, the motion of the belt is reversed by a shielded sheave assembly usually positioned near the bottom of the wellbore. Such sheave assembly includes a cylindrical housing supporting a rotatable drum. A weight bearing section adjacent to the drum, is designed to provide ballast to anchor the belt within the wellbore. Since the drum is housed completely within the housing, the belt does not contact the sidewall of the wellbore as the belt undergoes reversal. Hence belt wear and abrasion is minimized. A cross support maintains the integrity of the sheave assembly as well as provides a hook in case downhole fishing is required.

In accordance with method aspects, the present invention includes introducing the endless belt (that includes a series of fastener assemblies having positive traction capabilities) into the wellbore containing the pool of oil and water; passing the belt through the pool wherein both the oil and water are simultaneously collected and transferring the collected fluids uphole to the collection station where both oil and water are removed in a continuous but rapid manner. In introducing the belt into the wellbore, a spool of the belt is brought adjacent to the wellbore, an end of the belt is secured to prevent its movement. Next, the ballasting downhole sheave assembly is attached to the belt and then the combination is introduced into the wellbore and lowered to the proper depth of interest. The weight of the downhole elements brings about biasing action between the drive drums, squeezing sheave assembly, alignment drums and belt as collection starts.

A more detailed explanation of the invention is provided in the following description and claims and is illustrated in the accompanying drawings.

DETAILED DESCRIPTION OF THE INVENTION

Figure 1:
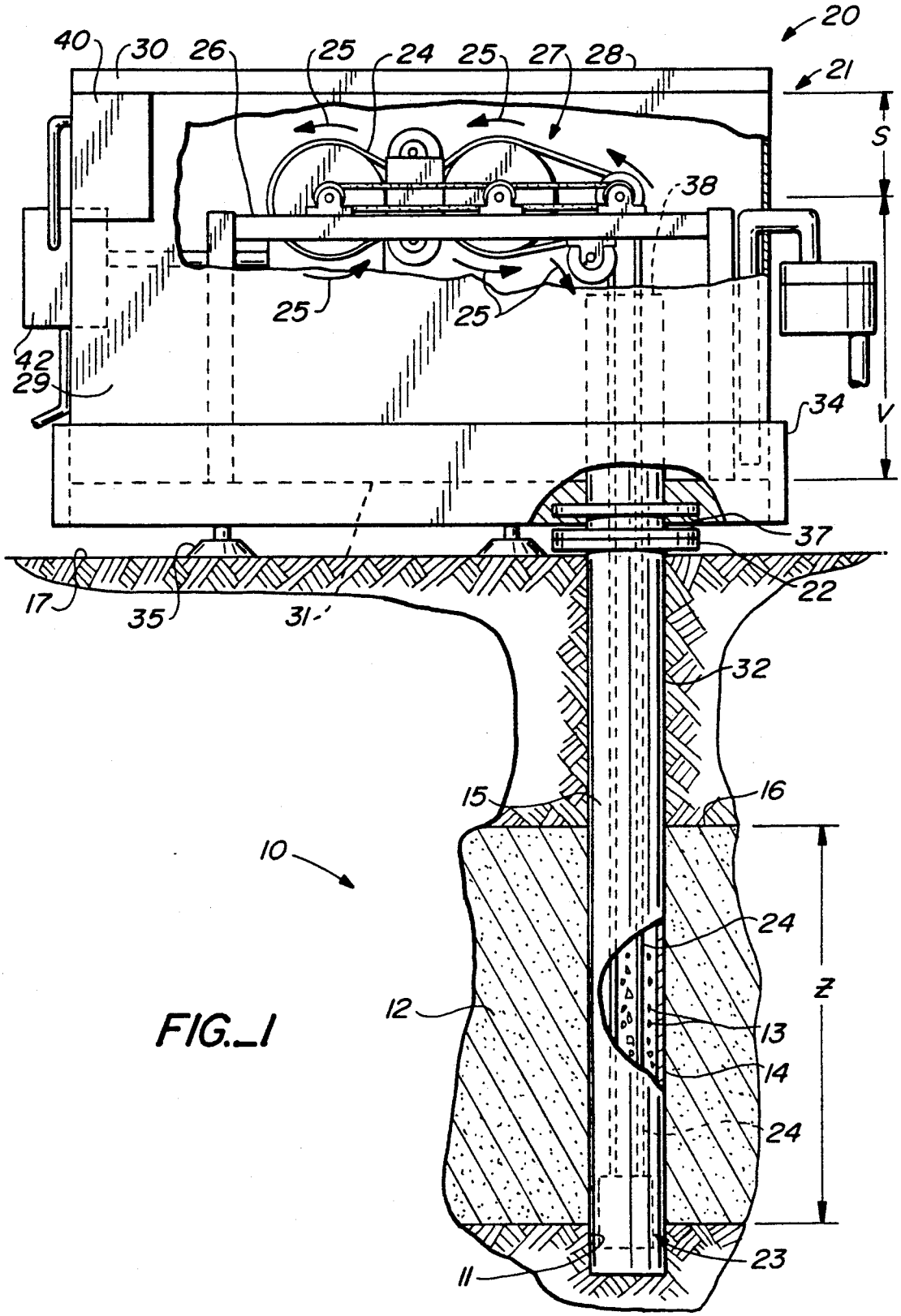
FIG. 1 is a side elevation, partially cut-away, of an earth formation penetrated by a wellbore illustrating operation of the apparatus and method of the present invention using a collection station at the earth's surface to drive an endless belt relative to the wellbore, and a downhole shielded sheave assembly around which the endless belt passes before returning to the earth's surface.

FIG. 1 is a side elevation, partially cut-away, of an earth formation 10 penetrated by a wellbore 11. The earth formation 10 includes an oil-bearing strata 12 whose depth is defined by vertical distance Z. The strata 12 is in communication with the interior of the wellbore 11 via a series of perforations 13. The perforations 13 are cut in side wall 14 of casing 15. Formation fluids from the strata 12 pass through the perforations 13 into the interior of the casing 15. The air-fluid boundry within the casing 15 is indicated at 16.

In order to lift the formation oil and water within the casing 15 to the earth's surface 17, the apparatus and method of the present invention generally indicated at 20 is used. Such apparatus 20 comprises collection station 21 at the wellhead 22 and a downhole sheave assembly 23 within the wellbore 11. The station 21 and the downhole assembly 23 are operationally interconnected by endless belt 24 driven into and from the wellbore 11 in the direction of arrows 25. Power to provide such movement is via drive and squeezing assembly 27 supported by upright frame 26 located in the collection station 21. Containment of the collected oil and water is via a collection tank 28.

Figure 2:
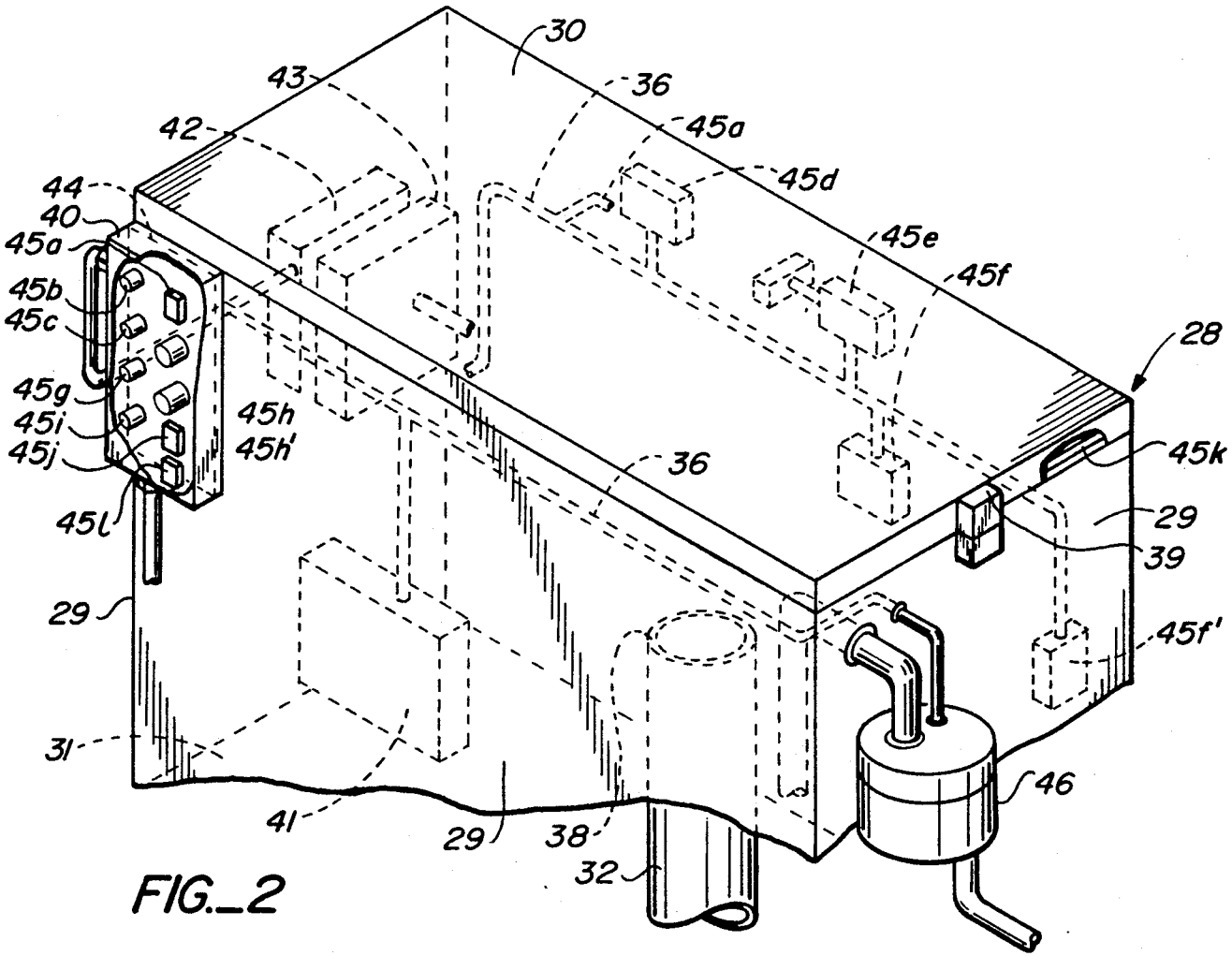
FIG. 2 is a perspective view, partially cut-away, of the collection station of FIG. 1 illustrating a collection tank including a tamper-proof lid and associated controller module to automate operations.

As shown in FIGS. 1 and 2, the tank 28 is of rectangular cross section and comprises a series of side walls 29, a lid 30 and a bottom wall 31 through which a flanged inlet pipe 32 protrudes. The bottom wall 31 is supported by a bed 34 that includes legs 35. In operation, the tank 28 is carried to the wellhead 22 on a truck bed (not shown). After the tank 28 has been unloaded and moved into correct position relative to the wellhead 22, the legs 35 comprising slidable or screwable tubes, can be extended to the correct height above the surface 17. This adjustability in elevation permits easy connection of inlet pipe 32 to the wellhead 22 via fixed length flanged coupler 37. Note that interior end 38 of the inlet pipe 32 extends above the bottom wall 31 a distance V to define a liquid-free space S. As shown in FIG. 2, the space S is defined between lid 30 and the the inlet pipe 32. Obviously, when the operator is in attendance and monitoring operations, the lid 30 is removed by release of a series of lock assemblies attached between the lid and the adjacent side walls 29. A typical lock assembly is illustrated at 39 in FIG. 2. In that way, tampering by children or vandals is minimized.

Also note that a power controller module 40 can be attached to the exterior surface of one of the side walls 29 of the tank 28. The controller module 40 is operationally controlled to define the operations of the following elements: activate and deactivate sealed heater 41, activate and deactivate drive belt motor 42 through transmission 43, pass required data to the recording module 44 and activate and deactivate transfer pump 46. Such control is fully automatic. Signals are generated based upon inputs provided to the controller module 40 via a series of transducer circuits indicated at 45*a*. . . 45*l*. Such transducer circuits are mounted in and about the tank 28. They can take a plurality of forms included but not limited to human-operated button switches, mechanical level switches, current sensors, thermoswitches and sensors, balancing circuits, set point circuits and the like, of conventional design.

Table I summarizes their operational characteristics. Note that electrical conduit 36 carries a wiring harness (not shown) that interconnects all circuit elements with a conventional outside source of energy (not shown).

TABLE I

| No | Name | Function | Output |
|---|---|---|---|
| 45a | Thermostat | Temperature | True, False |
| 45b | Reset Switch | Reset Circuitry | True, False |
| 45c | Safety Switch | Human Interrupt | True, False |
| 45d | Lid Switch | Lid Interrupt | True, False |
| 45e | Belt Switch | Belt Interrupt | True, False |
| 45f | Hi Level Switch | Fluid Set Pts. | True, False |
| 45f' | Lo Level Switch | Fluid Set Pt. | True, False |
| 45g | Emergency Sw' | Human Interrupt | True, False |
| 45h | Drive Motor | Over Current Ind. | True, False |
| 45h' | Pump Motor | Over Current Ind. | True, False |
| 45i | Reset Switch | Fail/safe Reset | True, False |
| 45j | Motor Speed | Speed Set Pts. | True, False |
| 45k | Safe Trip Line | Human Interrupt | True, False |
| 45l | Pump Motor | Run time Set Pt. | True, False |

The controller 40 has a primary function in controlling the operation of heater 41, drive motor 42 and transmission 43 and transfer pump motor 46.

It activates the pump 46 to transfer fluid from the tank 28 when a certain pre-selected fluid level is exceeded and to shut the pump 46 off when the level drops to a minimum level. In addition, the controller 40 terminates operation of pump 46 under two further control conditions: (i) if a pre-determined time interval is exceeded, and (ii) if excessive current is drawn. In the matter of heater 41, the controller 40 activates the same for a set time interval before the transfer pump 46 is activated if the temperature of the fluid is below a preselected temperature. This insures that the transferred fluid in the tank 28 is not too viscous and eases energy transfer requirements of the invention. In addition, the controller 40 also terminates operations of drive motor 42 via transmission 43 under these additional control conditions: (i) if speed set points are exceeded and (ii) if excessive current is drawn.

Besides controlling operations as noted above, the controller 40 also performs other functions. These relate to providing safe operations even if the apparatus of the invention is unattended. For example, the controller 40 determines if the lid 30 is ajar or if there is excessive motion about the safety line 45*k*, and automatically terminates operations. In addition, indications as to the status of heater 41, motor 42 and transmission 43 and pump 46 are provided at the controller 40. Still further, permanent records can be provided within recording module 44 to record belt revolutions and pump on-time as a direct measure of the transfer rate of the oil and water from the tank 28. All of these operations are automatically achieved in the manner set forth in more detail below. Note also that many of the transducer circuitry elements are mounted within the controller 40 while their associated sensing elements are mounted about the interior of the tank 28 as required.

Power-on energy for the controller 40 passes via the reset switch circuits 45*b* and 45*i*. If the latter circuit is deactivated for any reason, activation automatically resumes operations without human intervention.

Controller Module 40

Figure 3:
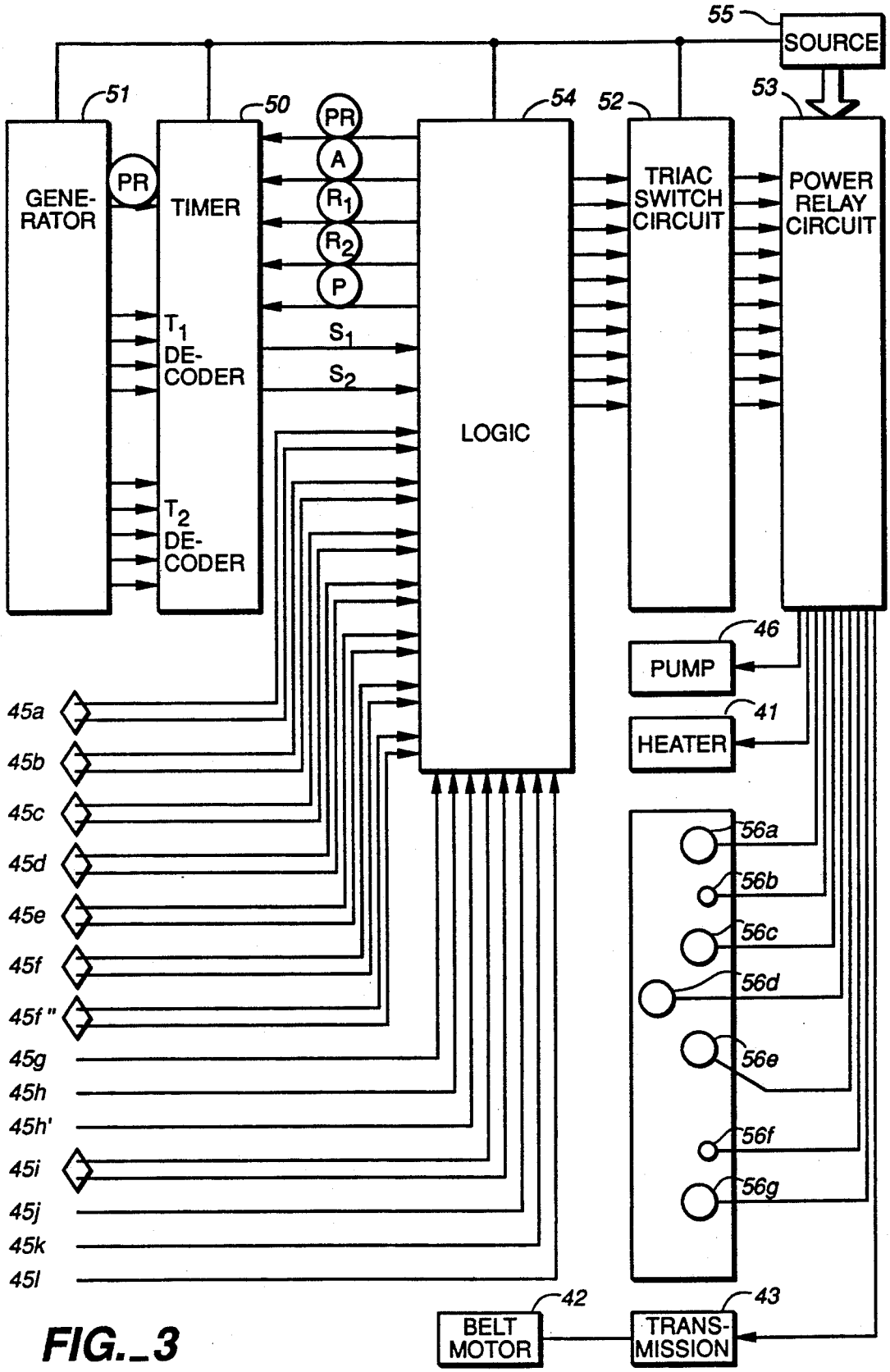
FIG. 3 is a block diagram of the controller module of FIG. 2.

FIG. 3 illustrates the circuit elements comprising the controller module 40 in block form.

As shown, timing circuit 50 decodes timing signals from pulse generator circuit 51. As a result, signals S1 and S2 are generated to drive triac switch circuit 52 and power relay circuit 53 through logic circuit 54. In that way, power from source 55 can be controllably applied to the following: pump 46, heater 41, belt motor 42 and transmission 43, counter/indicators 56*a* . . . 56*g* including a pair of glow lamps.

In more detail, timing circuit 50 consists of a series of decode gates (not shown). They decode timing pulses from pulse generator circuit 51. As a result, outputs are generated that have variable periods, say equal to minutes or hours.

Within the pulse circuit 51, conventional AC power is first converted to pulses. In turn, the pulses drive a counter. The output of the counter are multiples of the input, each having a switching rate that is one-half of the prior output. In the switch and relay circuits 52,53, a series of time delays are established using a selected pulse rate to measure the time between different circuit operations.

Still further, logic circuit 54 includes elements of the series of transducer circuitry 45*a*–45*l* such as sensors in circuit with a debounce circuit, logic gate and latching circuit (not shown). When activated (or deactivated), an OR gate can be driven, the output of which indicates a selected operating condition. For example, activation of the group of circuit elements associated with unsafe operations, will indicate such unsafe conditions are present and automatically drive a latching circuit. Such latching circuits include triac switches whereby the pump 46 and/or drive motor 42 and transmission 43 and associated moving elements are decoupled from a power source. When the heater 41 is to be used, set point temperatures of the collected fluids, are used activate and deactivate the former in a similar manner. Additionally, indicator/counters 56*a* . . . 56*g* are in circuit with certain of the triac switches of circuit 52 to indicate operational status and/or conditions. The conditions monitored include activation and deactivation of the heater 41, drive motor 42 and transmission 43 and pump 46; the number of belt revolutions; and rate of discharge.

In order that the apparatus and method of the present invention have the capability of operation essentially unsupervised, there must be cooperation in the design of the endless belt 24, downhole sheave assembly 23 and drive and squeeze assembly 27 of the present invention. In that way, operation in remote areas at minimum cost, is assured. These elements will now be described in detail in FIGS. 4–18.

Drive and Squeeze Assembly 27

FIGS. 4–10 describe driving and separating assembly 27 in detail.

As shown in FIG. 3, the driving and squeezing assembly 27 is supported by the upright frame 26 as previously mentioned. The frame 26 includes legs 61 and arms 62. The legs 61 are located in contact with the bottom wall 31 of the tank 28. As shown in FIG. 5, the arms 62 attached to a series of shafts 63*a* . . . 63*d* on the frame 26 via pairs of bearing blocks 64*a* . . . 64*d*. Located near the center of each of the shafts 63*a* . . . 63*d* are a series of drums or sheaves indicated at 67, 69, 70 and 74. These drums or sheaves 67, 69, 70 and 74 are, individually, rotated to cause the endless belt 24 to travel in essentially a truncated, horizontal figure eight pattern relative to the support frame 26. The arrows 25 (FIG. 4) indicate belt motion as follows. First, the belt 24 exists from inlet pipe 32 in a vertical direction, then passes in a more horizontal direction via alignment drum 67. Then the belt 24 traverses from first upper sector 68 of first drive drum 69, thence to second drive drum 70 where the direction of travel of the belt 24 reverses over sector 71. Between the drive drums 69, 70 is a squeezing subassembly 72. Squeezing subassembly 72 is not attached to the frame 26 but tensions and squeezes the belt 24 to remove fluids solely as function of weight as discussed in more detail below. The belt 24 then passes over a lower sector 73 of first drive drum 68, thence over alignment sheave 74 and finally into pipe 32.

Note that shafts 63*a* . . . 63*c* are co-planar. Shaft 63*d* is vertically offset a distance that is equal to the width of the horizontal arm 62 of the frame 26. Additionally, bearing block pairs 64*a* . . . 64*d* are mounted through slots (not shown) in the arms 62 of the frame 26. Thus proper alignment of the alignment drum 67 and of the alignment sheave 74 with pipe 32, is assured. Also, maximizing the frictional connection of the belt 24 and sectors 68, 71 and 73 (of drums 69 and 70), is likewise brought about.

The smaller diameters of the alignment drum 67 and the alignment sheave 74 coupled with the vertical positioning and independent suspension of squeezing subassembly 72, provide further advantages. They are directly related to the goal of maximizing sector length about the circumference of the drive drums 69 and 70. Of equal value in this regard is the design of the interconnecting surfaces of the belt 24 and the drive drums 69 and 70 which will be discussed in more detail below.

Figure 4:
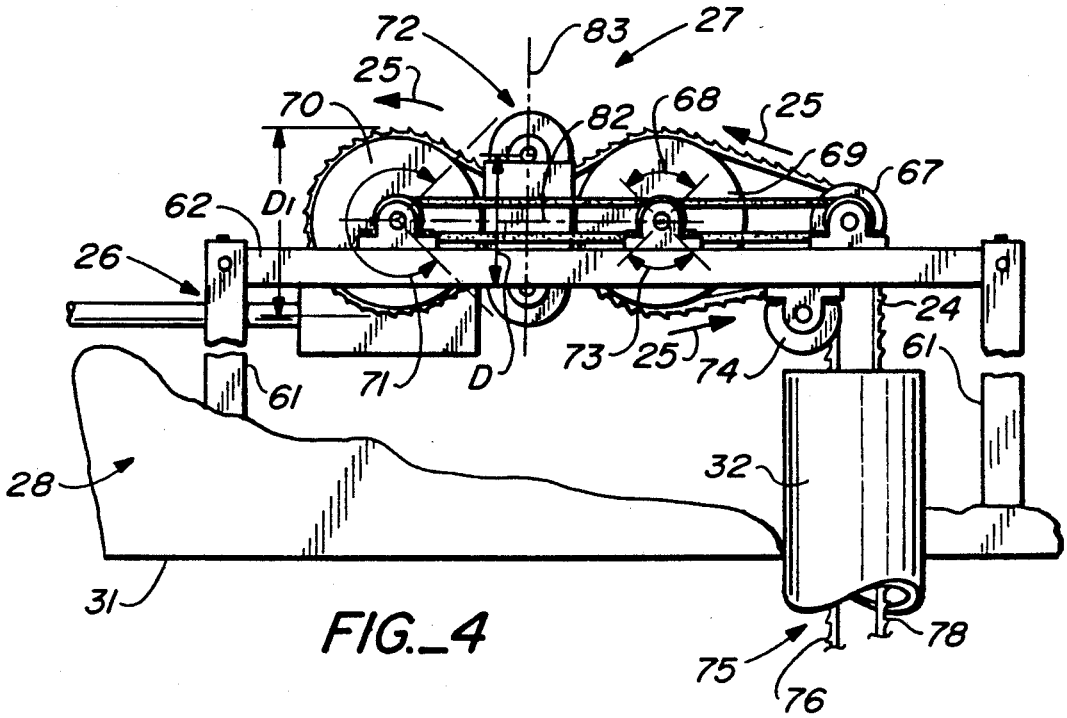
FIGS. 4 and 5 are side and top elevational views, respectively, also partially cut-away, of the collection station of FIGS. 1 and 2 illustrating the drive drums, squeezing subassembly and alignment drums as well as the movement of the endless belt position relative to the drums and squeezing subassembly.
Figure 5:
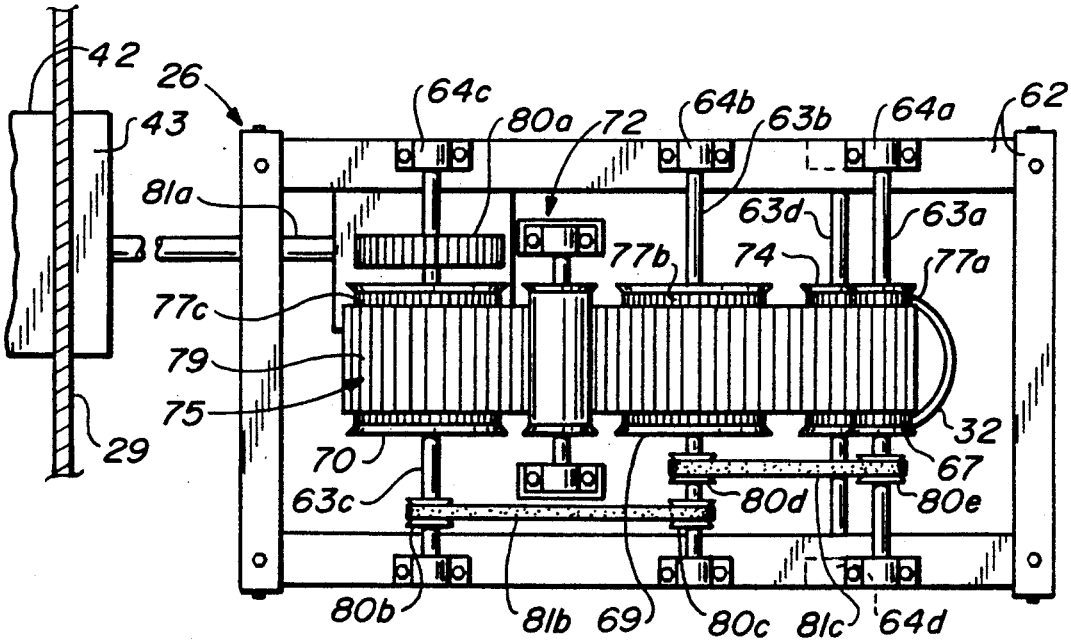

Suffice it to say with reference to FIG. 4, that the endless belt 24 is provided with a series of fastener assemblies 75. Each assembly 75 terminates on one side of belt 24 in an enlarged base 78 and on the other side in a cap wedge 76. The wedges 76 form a sprocketed tread on the belt 24 that contact in positive fashion similarly sawtooth patterned surfaces 77*a*, 77*b*, 77*c* of drums 67, 69 and 70, respectively (FIG. 5). In that way, positive traction is provided therebetween. As a result, required rotational velocities of the drums 67, 69 and 70 to efficiently pump a preset volume of fluid, are surprisingly low (when compared to prior art systems).

FIG. 5 also illustrates that drums 67, 69 and 70 are directly driven via sprockets 80*a* . . . 80*e* and associated drive linkages 81*a* . . . 81*c*. Such drive power originates at drive motor 42 and transmission 43 positioned at the side walls 29 of the tank 28. It is then transferred to the sprockets 80*a* . . . 80*e* and associated drive linkages 81*a* . . . 81*c*. Squeeze subassembly 72, however, is not directly connected to the drive motor 42 and transmission 43, but is indirectly driven in rotation by its connection to the moving belt 24. Moreover, such subassembly 72 is clearly seen to be independently suspended. As shown in FIGS. 4 and 5, subassembly 72 is movingly supported on portions the belt 24 that stretch between sectors 68, 71 and 73 of the drums 69 and 70, and not on frame 26.

Squeeze Subassembly 72

Figure 6:
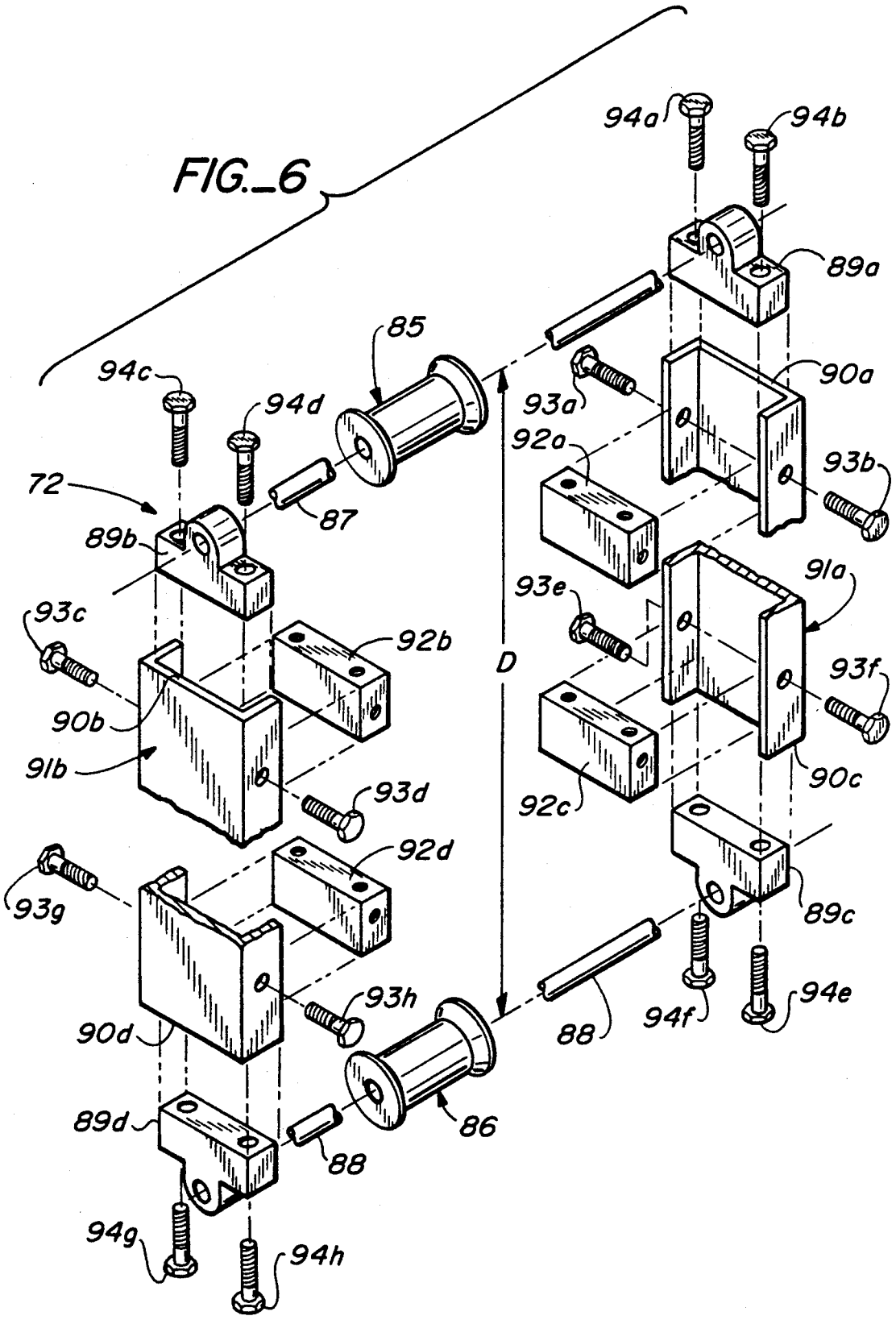
FIG. 6 is an exploded perspective view of the squeezing subassembly of FIGS. 4 and 5.

FIG. 6 indicates that squeezing sheaves 85 and 86 are permanently attached to shafts 87,88, respectively. The shafts 87,88 are, in turn, journalled within bearing blocks 89*a* . . . 89*d*. Each bearing block 89*a* . . . 89*d* is attached at a respective end 90*a* . . . 90*d* of vertically extending support legs 91*a*, 91*b*. In order that the support legs 91*a*, 91*b* be constructed at minimum cost, U-shaped channelling is preferred. Hence, matching inserts 92*a* . . . 92*d* are attached via a series of threaded bolts 93*a* . . . 93*h*. Platforms thus formed, receive the bearing blocks 89*a* . . . 89*d*. Attachment of the bearing blocks 89*a* . . . 89*d* to the inserts 92*a* . . . 92*d* is by a series of threaded bolts 94*a* . . . 94*h*.

In operation, note in FIGS. 4 and 6 that the space D between the squeezing sheaves 85,86 is fixed. This results from their shafts 87, 88 being attached to the fixed bearing blocks 89*a* . . . 89*d*. Likewise, by relating the space D to the diameters D1 of the drive drums 69, 70 (FIG. 4) wherein D1<D, the lengths of sectors 68, 71 and 73 around the circumference of such drums can be maximized. In this regard, drive drum diameters 69, 70 equal to 12 inches and a space D of about eight inches, results in sector lengths of twenty-four and ten inches, respectively. Note also in this regard in FIG. 4 that the axes of rotation of the drums 69 and 70 and of the sheave subassembly 72 define planes of rotation 82 and 83. Because of the interrelationship of these parts, the planes of rotation 82 and 83 are fixed in perpendicular relationship to each other.

Drive Drums 69, 70

Figure 7:
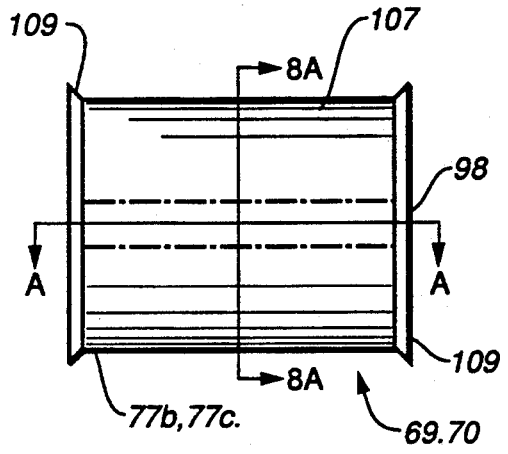
FIG. 7 is a side elevation of the drive drum of FIGS. 3 and 5.
Figure 8A:
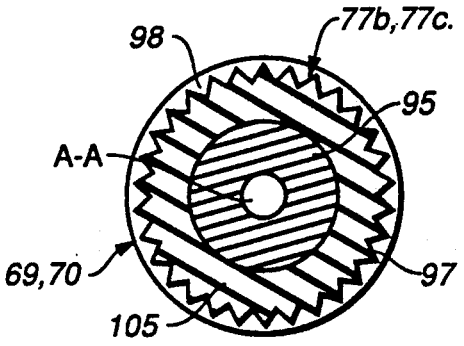
FIG. 8A is a section taken along line 8A—8A of FIG. 7.
Figure 8B:
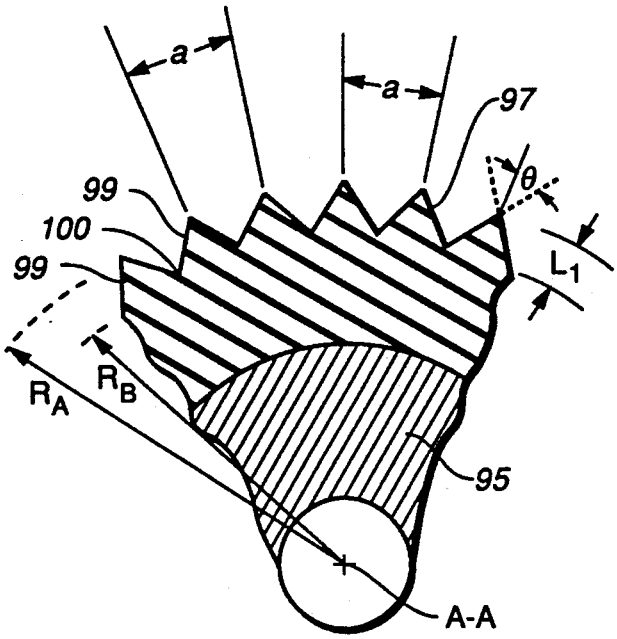
FIG. 8B is a detail of the sectional view of FIG. 8A.

FIGS. 7, 8A and 8B illustrate drive drums 69, 70 in more detail.

As shown, each drive drum 69, 70 is seen to comprise the sawtoothed patterned surface 77*b* and 77*c* previously mentioned. Such surfaces 77*b* and 77*c* are each formed about a metallic cylindrical core 95 (FIG. 8A) bonded with an outer cylindrical rim 96 of a flexible material such as synthetic rubber, and are sprocketed. Hence, the resulting sawtooth pattern defines rows of teeth 97 of common height L1. Each row 97 is of common length L parallel to the axis of symmetry A—A of the drum 69, 70, see FIG. 7. End plates 98 attach to the ends of the core 95 and of the rim 96 to complet the assembly. Between neighboring peaks, the distance a is constant around the entire circumference of the drum 69, 70. Radii Ra and Rb define peaks 99 and troughs 100, respectively, of each tooth 97. The shape of the teeth 97 are also the same from tooth-to-tooth since also angle $\theta$ measured between a line passing through the axis of symmetry A—A of the drum and each peak 99, and the surface projection of the surfaces of each tooth 97.

Figure 15:
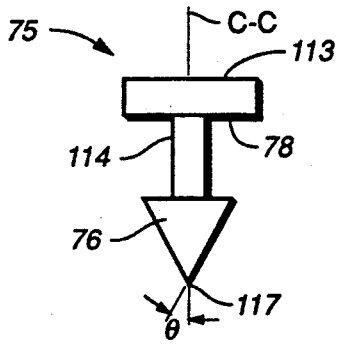
FIGS. 15 and 16 are side and front detail views, respectively, of the fastener assembly of FIG. 14.

From an operational standpoint, it is desirable that teeth 97 have flexibility in the region near each peak 99. This permits the matching sprocketed tread pattern of the belt 24 to easily mesh with the teeth 97. That is, as shown in FIG. 15, the angle $\theta$ of each wedge 76 (of the associated fastener assembly 75) as measured between a line passing through the axis of symmetry C—C and the protuberence segment 117, and the surface projection of the surfaces defining each wedge 76, matches the angle $\theta$ of similar projections associated with teeth 97 of the drums 69, 70. Moreover, there is a further advantage. Even though each wedge 76 of the belt 24 may undergo slippage, the flexibility of the peaks 99 allows the belt 24 to easily move from one sprocket trough 100 to an adjacent trough without undue wear. But when there is proper engagement, there is sufficient frictional force developed between the belt 24 and drum or sheave 67, 69, 70 to permit heavy loads under greasy and oily conditions, to be easily transferred from place-to-place by the belt.

Alignment Drum 67

Figure 9:
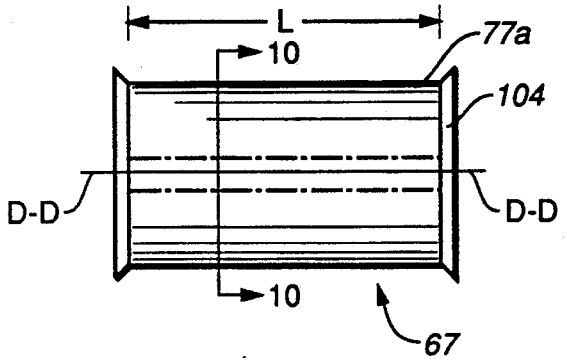
FIG. 9 is a side elevation of the alignment drum of FIGS. 4 and 5.
Figure 10:
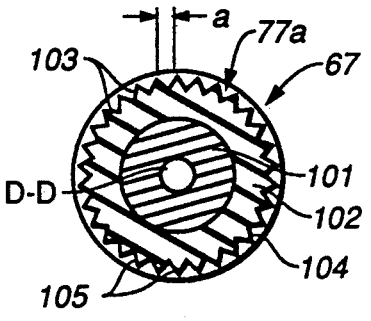
FIG. 10 is a section taken along line 10—10 of FIG. 9.

FIGS. 9 and 10 illustrate the construction of alignment drum 67 in more detail.

As shown, the alignment drum 67 is of a construction similar to that of the drive drums 69, 70 except its diameter is less. In one example, the diameter of drum 67 is equal to about five inches.

Such drum 67 has the familiar sawtoothed patterned surface 77*a* as mentioned before. Such surface 77*a* is formed about a metallic cylindrical core 101 bonded with a sprocketed rim 102 of a flexible material such as synthetic rubber. At the outer circumference, rows of teeth 103 are defined, each row 103 being of common length L1 parallel to the axis of symmetry D—D, see FIG. 9. End plates 104 attach to the ends of the core 101 and of the rim 102. Between neighboring peaks 105, the distance "a" is also constant around the entire circumference of the drum 67. The shape of the teeth are also the same from tooth-to-tooth since also the angle measured between projections through the axis of symmetry D—D of the drum 67 and each peak 105, and the surface projections of the surfaces of each tooth 103, is constant from tooth-to-tooth.

From an operational standpoint, it is desirable that the teeth 103 also have flexibility in the region near each peak 105 for the same reasons as given before. This permits the matching teeth pattern of the belt 24 to easily mesh with the teeth 103. That is, as before explained with reference to FIG. 15, the angle $\theta$ measured between projections through the axis of symmetry C—C of the wedge 76 and each protuberance segment 117, and the surface projections of the surfaces of each wedge 76, match that of similar projections associated with teeth 103 of the drum 67.

Alignment Sheave 74

Squeezing Sheaves 85, 86

Figure 11:
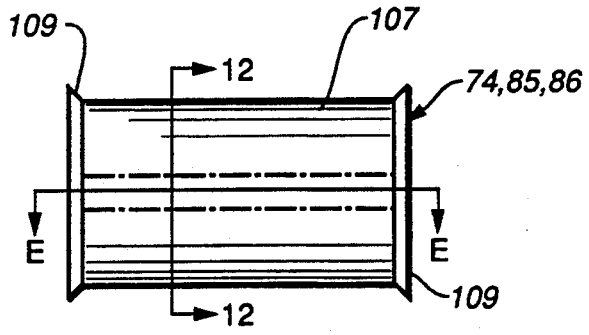
FIG. 11 is a side elevation of the squeezing sheave and alignment sheave of FIGS. 4 and 5.
Figure 12:
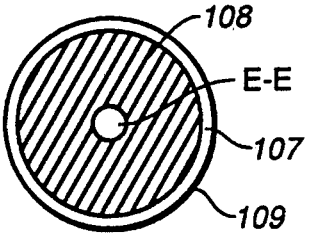
FIG. 12 is a section taken along line 12—12 of FIG. 11.

FIGS. 11 and 12 illustrate the construction of alignment sheave 74 and squeezing sheaves 85, 86 in more detail.

As shown, each such sheave 74, 85, 86 is formed with an outer surface 107, a central cylindrical core 108 and terminating end plates 109. The end plates 109 are seen to be perpendicular to axis of symmetry E—E. The outer surface 107 is smooth and even. Such surface 107 hence is unlike the surface pattern of the drive drums 69, 70, but generates sufficient friction force since such force is directly related to (i) the weight of the sheave subassembly 72 and (ii) a factor K where K is directly related to the weight of the belt 24 including that portion within the wellbore, and the weight of the fluid adhering to the belt. The maximum value of K is, of course, where k=1. Additional surfacing of the core 108 to add a sawtoothed coating, e.g., is unnecessary and is not cost effective.

Endless Belt 24

Figure 13:
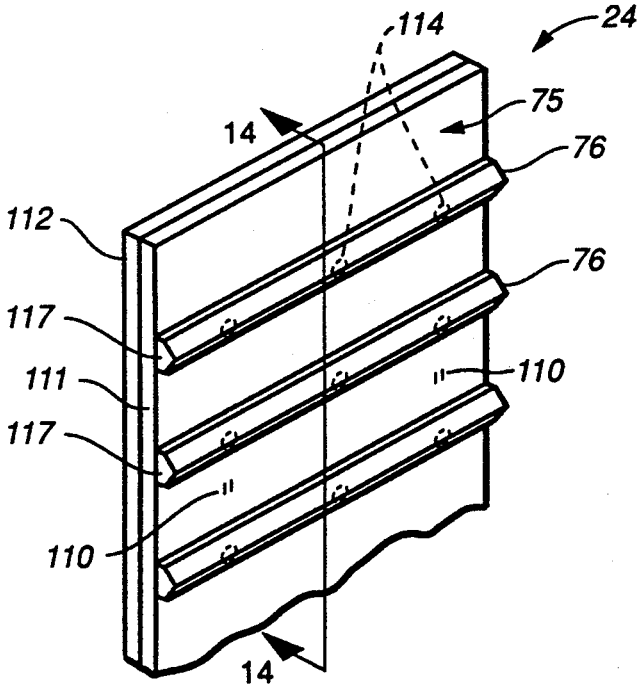
FIG. 13 is a enlarged perspective view of the endless belt of FIGS. 4 and 5.
Figure 14:
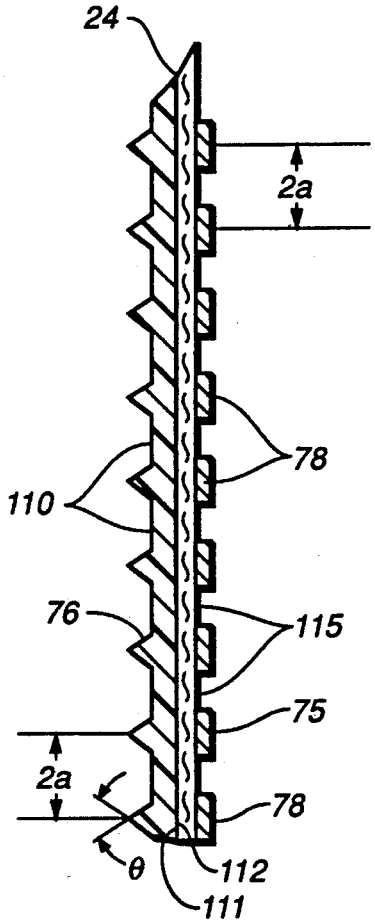
FIG. 14 is a section of the endless belt of FIG. 13 taken along line 14—14 thereof illustrating the two-ply construction of the belt including a series of fastening assemblies to securing the layers of the belt to each other.

FIGS. 13, 14, 15 and 16 describe endless belt 24 in more detail. FIG. 13 is partial cut-away perspective of the belt 24; FIG. 14 is a section of the belt 24 illustrating the two ply construction including the series of fastening assemblies 75 terminating on opposed sides of the belt 24.

Figure 16:
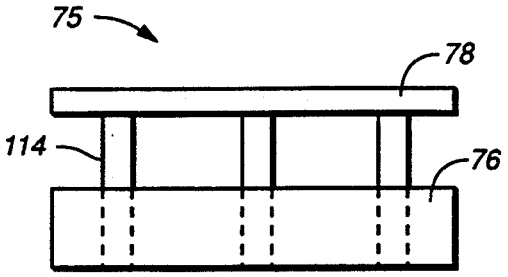

Referring to FIGS. 13 and 14, each assembly 75 terminates on an underside 110 of the belt 24, in a capping wedge 76 securing the layers 111, 112 to each other. FIGS. 15 and 16 are side and front detail views, respectively, of each fastener assembly 75.

As shown, the fastener assembly 75 of FIGS. 15 and 16 that is used in the present invention, includes an enlarged base 79 whose reduced series of tines 114 penetrates through the broad surfaces 115 of the belt 24 into permanent contact with opening in the cap-like wedge 76. The wedge 76 includes the protuberance segment 117 previously mentioned. It is of triangular cross section. Because of their shape and geometrical pattern, the series of wedges 76 form a sprocketed tread along the belt 24. Better adherence of the latter to like-pattern surfaces of the drive and alignment drums 69, 70 and 67, respectively, results. Wedges 76 are constructed on center-to-center spacing equal to 2*a*. The spacing between the teeth of the drums 67, 69 and 70 is equal to a. Thus there is easy meshing of these elements when operations occurs. Yet there is firm adherence of the two plies to each other along such broad surfaces 115.

Still further, layer 111 of the belt 24 can be constructed from a high strength plastics material that also can withstand surface contact with the drive drums without fracturing. Preferably, the high strength layer 111 should be chosen from the group of materials that include oriented fibers of polyester, polyethylene, polybenzimibazole, para-aramid, graphite, boron and silicon carbide. Second layer 112 should be formed a hydrophilic (i.e. water-absorbing) material such as felt. Hence such two-ply construction as herein described, permits both removal of water and oil from the formation at the same time. As a result, fluid level within the production zone can be more effectively lowered, and the formation channels for oil transfer can be unplugged because of the reduction in associated backpressure.

Downhole Sheave Assembly 23

Figure 17:
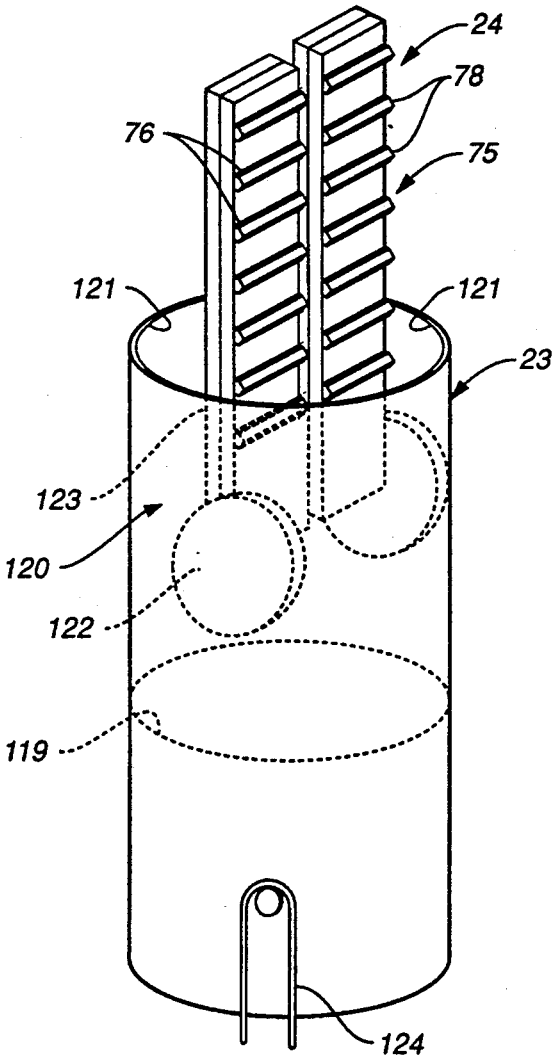
FIG. 17 is a perspective view of the downhole sheave assembly of FIG. 1.
Figure 18:
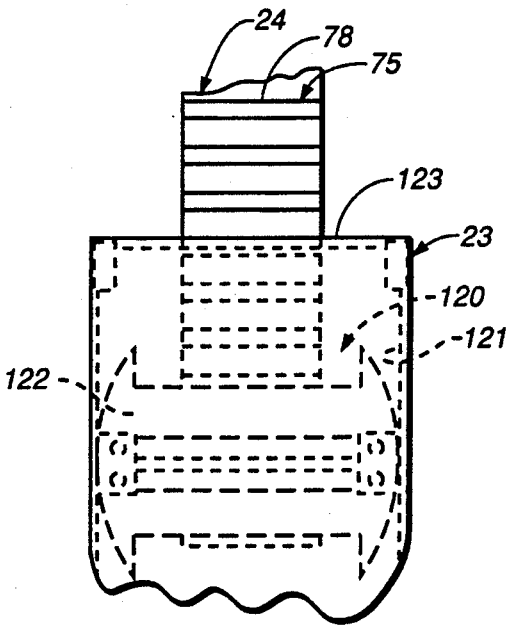
FIG. 18 is a partial side view of the downhole sheave assembly of FIG. 17.

FIGS. 17 and 18 is a perspective view and partial side view, respectively, of the preferred downhole sheave assembly 23 of the present invention.

As shown in FIGS. 17 and 18, the belt 24 is seen to be rotatably anchorable using downhole sheave assembly 23. The assembly 23 includes a cylindrical housing 120 at the far end of which a heavy cylindrically shaped weight section 119 is attached. Also within the interior 121 of housing 20 is a rotatable drum 122. The drum 122 has a construction similar to that used for drive drums 69 and 70 i.e., sawtoothed surfaced. Since the drum 122 is completely within the housing 120, the belt 24 is not subject to be placed in contact with the sidewall of the wellbore. Hence wear and abrasion at the position where the belt 24 undergoes reversal, is avoided. Note also that a cross support 123 between the belt 24 can be used to maintain the structural integrity of the housing 120 as well as provides a hook in case downhole fishing is required. A hook assembly 124 through the weight section 119 is optional to permit the addition of more weight if needed.

Further Method Aspects

In accordance with method aspects, the present invention includes various steps that relate to producing the formation oil and water from the producing strata 12 penetrated by the wellbore 11 of FIG. 1. Assume that the casing 15 has been perforated by conventional means but the perforations 13 have become plugged due to sanding and/or similar problems. Also assume that tank 28 has been carried to the wellhead 22 using a truck (not shown).

After the tank 28 has been unloaded, it is moved into correct position relative to the wellhead 22. Then the tank 28 can be elevated above the surface 17. Such elevation is usually fixed. In order to more easily permit the connection of inlet pipe 32 to the wellhead 22, a fixed length flanged coupler 37 is cut to fit, and then mounted to complete the assembly. Then a portion of the endless belt 24 is unwound from its spool and threaded around the drum 122 (FIG. 17) of the downhole sheave assembly 23, then into and around the drive and squeezing assembly 27. Next the free end of the belt 24 is tied to the tank 28 using a releasable mount. Next, the ballasting sheave assembly 23 (and belt 24) is introduced into the wellbore 11 and the spool containing the belt 24 is unwound. Such rotation lowers the combination to the proper depth of interest. Then when a portion of the belt 24 is positioned atop the previously tied end of the belt 24 (at the releasable mount), they are attached together. For this purpose, fastener subassemblies 75 (FIGS. 14–16) are used. Then the previously tied end of the belt 24 is released. A strong biasing action between the drive drums 69, 70, the squeezing sheave assembly 72, the alignment drum and sheave 67, 74 and the completed endless belt 24, results. With the lid 30 of the tank 28 removed, the motor 42 is then activated using controller module 40 in association with activation of certain of the transducer circuitry 45*a* . . . 45*l*, thereby causing the movement of belt 24 around the downhole sheave assembly 23 into and from the wellbore 11.

Since the traction is both strong but can be flexibly changed, the belt 24 can be operated at high rates without developing undue vibration. That is, between the wedges 76 of the fastener subassembly 75 and the associated drive drums 69, 70; the alignment drum 67; and downhole drum 122, there is little vibration. Simultaneously, the passing belt 24 picks up both water and oil within the wellbore 11. These fluids 18 are next removed from the belt 24 using, primarily, the squeezing subassembly 72. The process is repeated in a rapid manner that can quickly drops the level of formation fluids including water 18 to new lows within the wellbore 11. With the lowered backpressure, the channels within the producing strata 12 as well as one or more of the perforations 13 can be cleaned and production of oil increased.

The lid 30 of the tank 28 is then attached, and the controller module 40 is placed in an automatic mode. Control of sealed heater 41, drive belt motor 42 and transmission 43, recording module 44 and transfer pump 46, results in the manner previously described. Such control is based uses the data provided to the controller module 40 via the series of transducer circuitry indicated at 45*a* . . . 45*l*, and occur as previously described.

Although illustrative embodiments of the invention has been shown in conjunction with an oil field environment, it is to understood that various modifications and substitutions may be made by those skilled in the art without departing from the spirit and scope of the present invention. For example, the endless belt of the present invention could also be used in other applications. One such application is in the food processing industry in which fluids from slaughtered animals, prepared vegetables, processed fruits and the like, may be carried on the belt and interfere with operations related to belt movement under load.

What is claimed is:

1. An apparatus for enhancing production of formation fluids from an earth formation penetrated by a wellbore having a wellhead using an endless belt driven by drive means, comprising:

(i) tank means including inlet means attached to said wellhead, said tank means also supporting drive and squeeze assembly means adjacent to said inlet means;

(ii) downhole sheave assembly means located downhole within said wellbore for returning said endless belt back up said wellbore, (iii) endless belt means operationally interconnected between said drive and squeeze means and said downhole sheave assembly means, whereby said endless belt means is driven in positive manner relative to said wellbore by said drive and squeeze assembly means through said inlet means into and through said formation fluids, (iv) said endless belt means comprising first and second layers including separate fastening means positioned on opposed surfaces thereof, said fastening means including wedge means that forms a sprocketed tread along said belt means whereby said belt can be more efficiently moved into and out of said wellbore by said drive and squeeze assembly means and lift and remove said formation fluids from said earth formation.

2. The apparatus of claim 1 in which said first layer of said endless belt means being constructed of a material selected from a group having high tensile strength, said second layer being constructed of a material selected from a group having hydrophilic properties whereby both water and oil are independently but simultaneously raised to said tank means where removal occurs.

3. The apparatus of claim 2 in which said first layer is formed of a material selected from the group comprising oriented fibers of polyester, polyethylene, polybenzimibazole, para-aramid, graphite, boron and silicon carbide.

4. The apparatus of claim 2 in which said second layer is formed of felt.

5. The apparatus of claim 4 in which said felt is formed of a material selected from the group comprising short fibers of polypropylene, polyethylene, nylon, orlon, dacron and flax.

6. The apparatus of claim 1 in which said first and second layers are of rectangular cross section each defining broad surfaces one of which being in surface contact with a like surface of the other layer.

7. The apparatus of claim 1 in which said drive and squeeze assembly comprises frame means supported within said tank means, drive drum means journalled to said frame means including first and second drive drums each of diameter D, and squeeze sheave subassembly means sandwiched between said first and second drive drums, said squeezing sheave subassembly means supported by moving portions of said endless belt means stretching between sector portions of said first and second drive drums, whereby said endless belt means is caused to travel in a truncated figure eight pattern within said tank means.

8. The apparatus of claim 7 in which said squeezing sheave subassembly means includes a pair of co-planar supports, first and second sheaves journalled to said pair of supports and also having parallel axes of rotation spaced apart a distance D1 and defining a first plane of rotation, said drive drum means being spaced apart and having parallel axes of rotation defining a second plane of rotation substantially perpendicular to said first plane of rotation, wherein said distance D1 between said first and second sheaves being less than said diameter D of said first and second drive drums whereby said squeezing sheave subassembly means supported by moving portions of said endless belt means stretching between sector portions of said first and second drive drums, causing said endless belt means to travel in said truncated figure eight pattern within said tank means.

9. The apparatus of claim 8 in which said squeezing sheave subassembly means supported by moving portions of said endless belt means stretching between sector portions of said first and second drive drums, generates a squeezing force F that is related to the weight of said squeezing sheave subassembly means by a factor K, said factor K being directly related to the total weight of the endless belt means and the weight of the formation fluids adhering to said endless belt means during operations.

10. The apparatus of claim 1 in which said downhole sheave assembly means located downhole within said wellbore includes a cylindrical housing, a return drum journalled within said housing and ballasting means also supported within said housing.

11. In a system for enhancing production of formation fluids from an earth formation penetrated by a wellbore having a wellhead provided with an endless belt, driver means and downhole return means, the improvement wherein said endless belt means comprises first and second layers each of rectangular cross section, said endless belt means including separate fastening means positioned on opposed broad surfaces thereof, said fastening means including wedge means that forms a positive tread along said belt means whereby said belt can be efficiently moved in positive manner by said driver means into and out of said wellbore to remove said formation fluids therefrom.

12. In a system for enhancing production of formation fluids from an earth formation penetrated by a wellbore having a wellhead provided with an endless belt, driver means and downhole return means, the improvement wherein said driver means comprises separately operational squeezing sheave subassembly means and first and second drive drums, said sheave subassembly means being sandwiched between said first and second drive drums, and being supported by moving portions of said endless belt means stretching between sector portions of said first and second drive drums, whereby said endless belt means is caused to travel in a truncated figure eight pattern.

13. The improvement of claim 12 in which said squeezing sheave subassembly means includes a pair of co-planar supports, first and second sheaves journalled to said pair of supports and also having parallel axes of rotation spaced apart a distance D1 and defining a first plane of rotation, said drive drum means being spaced apart and having parallel axes of rotation defining a second plane of rotation substantially perpendicular to said first plane of rotation, wherein said distance D1 between said first and second sheaves being less than common diameter D of said first and second drive drums whereby said squeezing sheave subassembly means supported by moving portions of said endless belt means stretching between sector portions of said first and second drive drums, causing said endless belt means to travel in said truncated figure eight pattern.

14. The improvement of claim 13 in which said squeezing sheave subassembly means supported by moving portions of said endless belt means stretching between sector portions of said first and second drive drums, generates a squeezing force F that is related to the weight of said squeezing sheave subassembly means by a factor K.

15. The improvement of claim 14 in which said factor K is directly related to the total weight of the endless belt means and the weight of the formation fluids adhering to said endless belt means during operations.

16. In a system for enhancing production of formation fluids from an earth formation penetrated by a wellbore having a wellhead provided with an endless belt, driver means and downhole return means, the improvement wherein said driver means comprises separately operational squeezing sheave subassembly means and first and second drive drums, said sheave subassembly means being sandwiched between said first and second drive drums, and being supported by moving portions of said endless belt means stretching between sector portions of said first and second drive drums, whereby said endless belt means is caused to travel in a truncated figure eight pattern, said drive drums each defining a cylinder and an axis of rotation, and radially terminating in a sawtoothed surface comprising rows of teeth all equally spaced relative to said axis of rotation.

17. The improvement of claim 16 in which said teeth of said sawtoothed surface define rows of teeth, each row being of common length L parallel to the axis of symmetry of said drive drums, and wherein the periodic peak-to-peak distance is constant around the entire circumference of each of said drive drums.

18. The improvement of claim 17 in which angle $\theta$ measured between a line passing through the axis of symmetry of said drive drums and each peak of said teeth of said sawtoothed surface and the surface projection of the surfaces of each tooth, is constant from tooth-to-tooth.

19. In a conveying device primarily designed to move oily or greasy materials using a combination of an endless belt and drum gear means for driving said endless belt, the improvement in which said endless belt and said drum gear means comprise, respectively, the following: (i) a plurality of fasteners, each of said fastening means including wedge means that together form a sprocketed tread along a broad surface of said belt, and (ii) a metallic inner housing that is rotatable about an axis of rotation, and a bonded partially flexible synthetic sprocketed rim attached to said housing flexibly engagable with individual wedge means between neighboring sprocket teeth wherein there is minimum wear to the belt including said wedge means even though said belt may undergo slippage and individual wedge means move from sprocket groove to sprocket groove about the circumference of said sprocketed rim.

20. The improvement of claim 19 in which said sprocketed rim of said drum gear means is provided with a minimum and maximum thickness dependent upon being adjacent to a sprocket groove and sprocket tooth, respectively but wherein the sprocket tooth is still flexible at its apex so as to minimize wear of said endless belt when slipping from sprocket tooth to an adjacent sprocket tooth while maximizing engagement area when engaged with said sprocket groove, especially under heavy loads and greasy conditions.

21. In a conveying device primarily designed to move oily or greasy materials using a combination of an endless belt and drum gear means for driving said endless belt, the improvement in which said endless belt comprises first and second layers and a plurality of fastening means attached therebetween, said fastening means designed both to fasten said first and second layers together and to form a sprocketed tread along a first broad surface of said first layer of said endless belt, said first layer being stronger in tensile strength than said second layer so that said belt is surprisingly able to withstanding wear and/or abrasions during operations.

22. The improvement of claim 21 in which each of said fastening means includes header means attached across a second broad surface of said second layer of said endless belt, wedge means attached across said first surface of said first layer forming said sprocketed tread therealong, and a series of pin means extending between said header means and said wedge means to secure said first and second layers together and form said sprocketed tread along said endless belt.

23. The improvement of claim 22 in which said header means and pin means of each of said fastening means are integrally formed and in which said wedge means includes a series of openings into which said pin means permanently attached.

24. A liquid transfer means such a pump, lifter or conveyer, primarily designed to remove oil and water from a well or other container, comprising:

(a) an endless belt that includes a first layer of a hydrophilic material, a high tensile strength second layer substantially coextensive with said first layer, and fastening means for attaching said first and second layers together so that the weight of absorbed water and clinging oil, sand or other particulate matter will be supported by said second layer in association with said fastening means during transfer thereof from said well or other container, said fastening means including sprocketed protrusions on a broad surface of said second layer forming a sprocketed tread therealong, (b) a holding tank in transfer contact with said well or other container for intermediate containment of said water, oil, sand and/or other particulate matter, said tank being penetrated by a series of sealed openings through which operational means protrude, (c) first and second drum gear means operationally connected to said operational means to cause rotation thereof, and drive said endless belt in an endless path into and from said well and/or container and said holding tank, each of said first and second drum gear means including an outer surface suitably provided with a sprocketed rim over which said sprocketed tread of said fastening means is releasibly griped and then released so as to cause travel of said endless belt relative to said well and/or container and said holding tank.

25. The liquid transfer means of claim 24 in which said first and second drum gear means includes frame means supported within said tank means, drive drum means journalled to said frame means including first and second drive drums, and squeeze sheave subassembly means sandwiched between said first and second drive drums, said squeezing sheave subassembly means supported by moving portions of said endless belt means stretching between sector portions of said first and second drive drums, whereby said endless belt means is caused to travel in a truncated figure eight pattern within said tank means.

26. The liquid transfer means of claim 25 in which said squeezing sheave subassembly means includes a pair of co-planar supports, first and second sheaves journalled to said pair of supports and also having parallel axes of rotation spaced apart a distance D1 and defining a first plane of rotation, said drive drum means being spaced apart and having parallel axes of rotation defining a second plane of rotation substantially perpendicular to said first plane of rotation, wherein said distance D1 between said first and second sheaves being less than common diameter D of said first and second drive drums whereby said squeezing sheave subassembly means supported by moving portions of said endless belt means stretching between sector portions of said first and second drive drums, causing said endless belt means to travel in said truncated figure eight pattern within said tank means.

27. The liquid transfer means of claim 26 in which said squeezing sheave subassembly means supported by moving portions of said endless belt means stretching between sector portions of said first and second drive drums, generates a squeezing force F that is related to the weight of said squeezing sheave subassembly means by a factor K, said factor K being directly related to the total weight of the endless belt means and the weight of the formation fluids adhering to said endless belt means during operations.

28. The liquid transfer means of claim 24 in which said second drum gear means includes a downhole sheave assembly means located downhole within a bore and includes a cylindrical ballasting means also supported within said housing.

29. An endless belt for use in environments having excess environmental fluids comprising first and second layers each of rectangular cross section, separate fastening means positioned on opposed broad surfaces thereof, said fastening means including a base on one broad surface, tine means attached to said base and protruding through said first and second layers and wedge means on another opposed said broad surface in attaching contact with said tine means, said wedge means including a protuberance means remote from said another broad surface that forms a positive tread along said belt means whereby said belt means can be efficiently moved in positive manner along a pathway irrespective of environmental fluids between said wedge means and a drive means.

30. The endless belt of claim 29 in which said wedge means is coextensive of one full side of one of said first and second layers normal to travel directions thereof so maximum engagement is provided between said wedge means and said drive means.

31. The endless belt of claim 29 in which said wedge means is centered along an axis of symmetry in the direction of travel of said first and second layers.

* * * * *